US005542907A

United States Patent [19]

Chou

[11] Patent Number: 5,542,907

[45] Date of Patent: Aug. 6, 1996

[54] MASSAGE APPARATUS WITH MULTIPLE VIBRATOR UNITS

[76] Inventor: Lai Chou, 172, Alley 99, Lane 10, Section 2 Changping Road, Peitun, Taichung 406, Taiwan

[21] Appl. No.: 298,412

[22] Filed: Aug. 30, 1994

[51] Int. Cl.[6] ..... A61H 1/00

[52] U.S. Cl. ..... 601/46; 601/49; 601/70

[58] Field of Search ..... 601/46, 48, 49, 601/56, 57, 58, 59, 61, 78, 97, 98, 100, 101, 103, 107, 108, 111, 134, 67, 69, 70; 606/204

[56] References Cited

U.S. PATENT DOCUMENTS

| | | | |
|---|---|---|---|
| 3,549,920 | 12/1970 | Tavel | 601/70 |
| 4,005,703 | 2/1977 | Rosen | 601/57 |
| 4,343,303 | 8/1982 | Williams | 601/46 |
| 5,152,708 | 10/1992 | Claugus | 601/46 |
| 5,334,131 | 8/1994 | Omandam | 601/70 |

FOREIGN PATENT DOCUMENTS

| | | | |
|---|---|---|---|
| 5-285182 | 11/1993 | Japan | 601/49 |

*Primary Examiner*—Robert A. Hafer
*Assistant Examiner*—David J. Kenealy
*Attorney, Agent, or Firm*—Bucknam and Archer

[57] ABSTRACT

A massage apparatus with multiple vibrator units including a converter and power supplier, a plurality of vibrator units and a base of hive type. The converter is electrically connected with the plurality of vibrator units respectively, and the base is provided with a plurality of cylinders for receiving the vibrator units selectively. Thus, the plurality of vibrator units can optionally massage either a single point or a specific area a patient.

3 Claims, 5 Drawing Sheets

MASSAGE APPARATUS WITH MULTIPLE VIBRATOR UNITS

The present invention relates to massage apparatus with multiple vibrator units, and more precisely, the present invention relates to massage apparatus in which a plurality of vibrator units are provided to operate either independently for a point massage or in a group for an area massage.

BACKGROUND OF THE INVENTION

Traditionally, treatment adopted by Chinese acupuncture or electronic acupuncture without medicine is functionally to stimulate so called vital points and nerve tissues in the human body so as to attain a specific remedial purpose. Unfortunately, not all patients can be cured in the traditional way, and on the contrary, patients who get little effect and even no effect may have a certain extent of muscle hardening around related vital points after treatment. In addition, blood in the area of muscle hardening becomes sticky and tends to solidify. This complication usually originates from the blood in the capillaries having an inadequate circulation which leads to a functionless metabolism so that nutrition is unable to nourish cells and nerve tissues. By only taking medicine or treating by acupuncture without normal circulation in the human body, it is not possible to cure disease as expected, and in fact may make it worse. In order to make up the deficiencies of traditional medicine, a high frequency oscillation is introduced in prior art massage devices to enhance the circulation in the capillaries directly, and in addition, an electromagnetic wave, which is able to correct the physical property of ferric ions in the blood, is also applied to promote circulation in the capillaries indirectly. Prior art massage devices contain problems and some major drawbacks are listed as follows:

1. The prior art devices are designed to be operated by hand for a point massage only, that is, an area massage could not be performed.

2. Usually, batteries are used as the power source in a prior art device, but it can be understood that electric charges in batteries is very limited and there is a possibility that the prior art device stops running due to an inadequate electric charge in the batteries so that an engaging massage treatment has to be interrupted till a replacement for new batteries is complete.

3. An electromagnetic ball formed of hard material is fitted on a massage head in a prior art device for pressing against the skin and is an uncomfortable experience for a patient to endure during treatment.

4. The electromagnetic ball in a prior art device is limited in size so that an effective electromagnetic wave can not be generated.

SUMMARY OF THE INVENTION

The crux of the massage apparatus with multiple vibrator units according to the present invention resides in the fact that the massage apparatus is provided with a plurality of vibrator units, a converter and power supplier, and a base similar to a hive. Each vibrator unit comprises a vibrating motor and a massage head containing a coil. Each of the vibrator units is electrically connected to the converter and power supplier individually. If a certain number of the vibrator units are selectively received in the base as required, a specific massage for a greater area can be effectively attained. If a single vibrator unit is operated by hand, a massage for a vital point can be simply achieved.

An object of the present invention is to provide massage apparatus with multiple vibrator units in which a plurality of vibrator units can be selectively received in a hive type base to massage a specific area of a patient.

Another object of the present invention is to provide massage apparatus with multiple vibrator units in which a single vibrator unit is capable of operation by hand to massage a specific vital point.

Another object of the present invention is to provide massage apparatus with multiple vibrator units whereby a massage for a specific location or area can be achieved while a patient is lying on a bed.

Another object of the present invention is to provide massage apparatus with multiple vibrator units in which a massage head of flexible plastic on each vibrator unit contains a coil connected with a power source of direct current for generating an effective electromagnetic wave.

BRIEF DESCRIPTION OF THE DRAWINGS

The present invention will be further illustrated, by way of example, with reference to the accompanying drawings in which.

DETAILED DESCRIPTION OF THE PREFERRED EMBODIMENT

Figure 1:
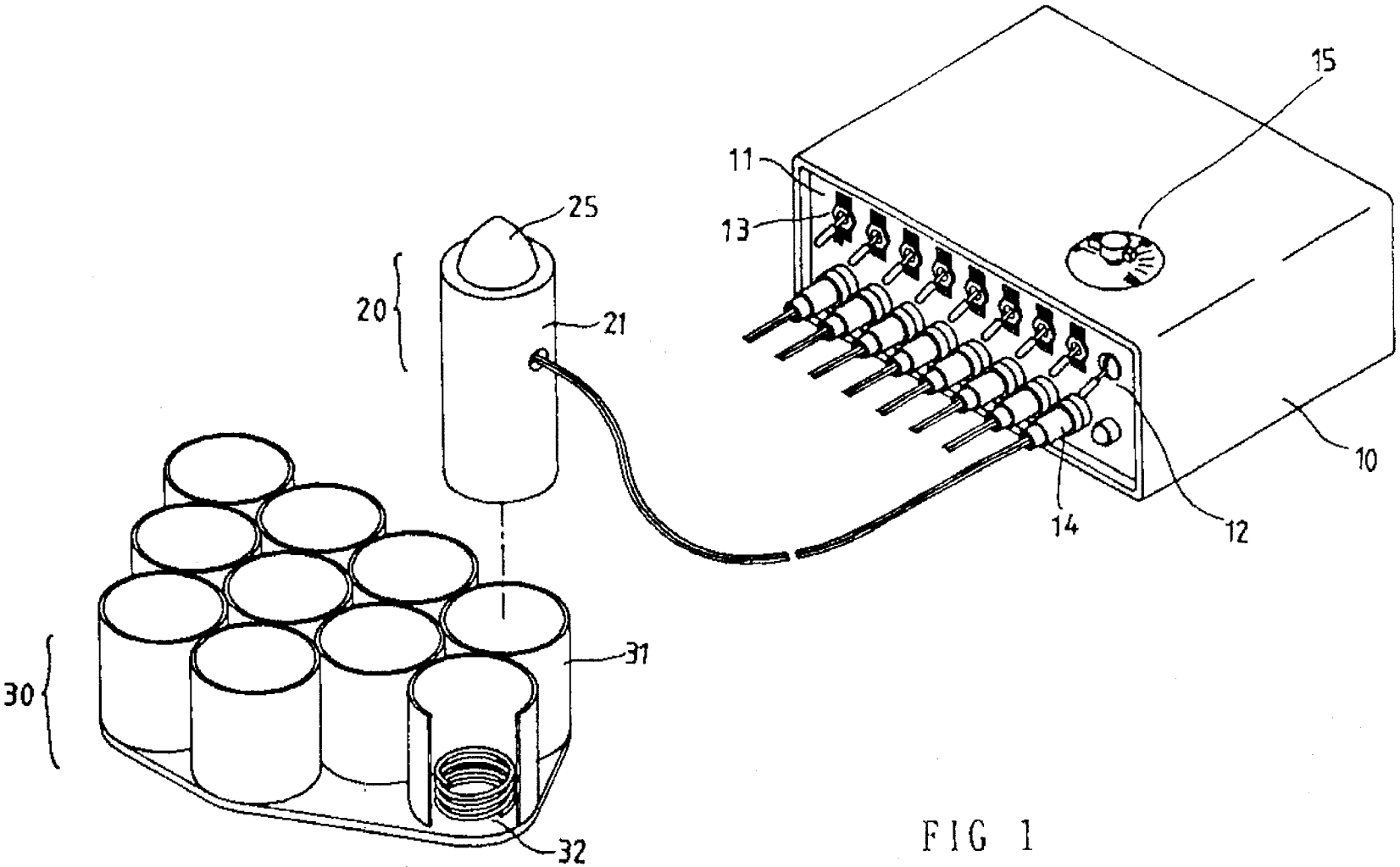
FIG. 1 is a perspective and partial cutaway view showing a preferred embodiment of the present invention.
Figure 2:
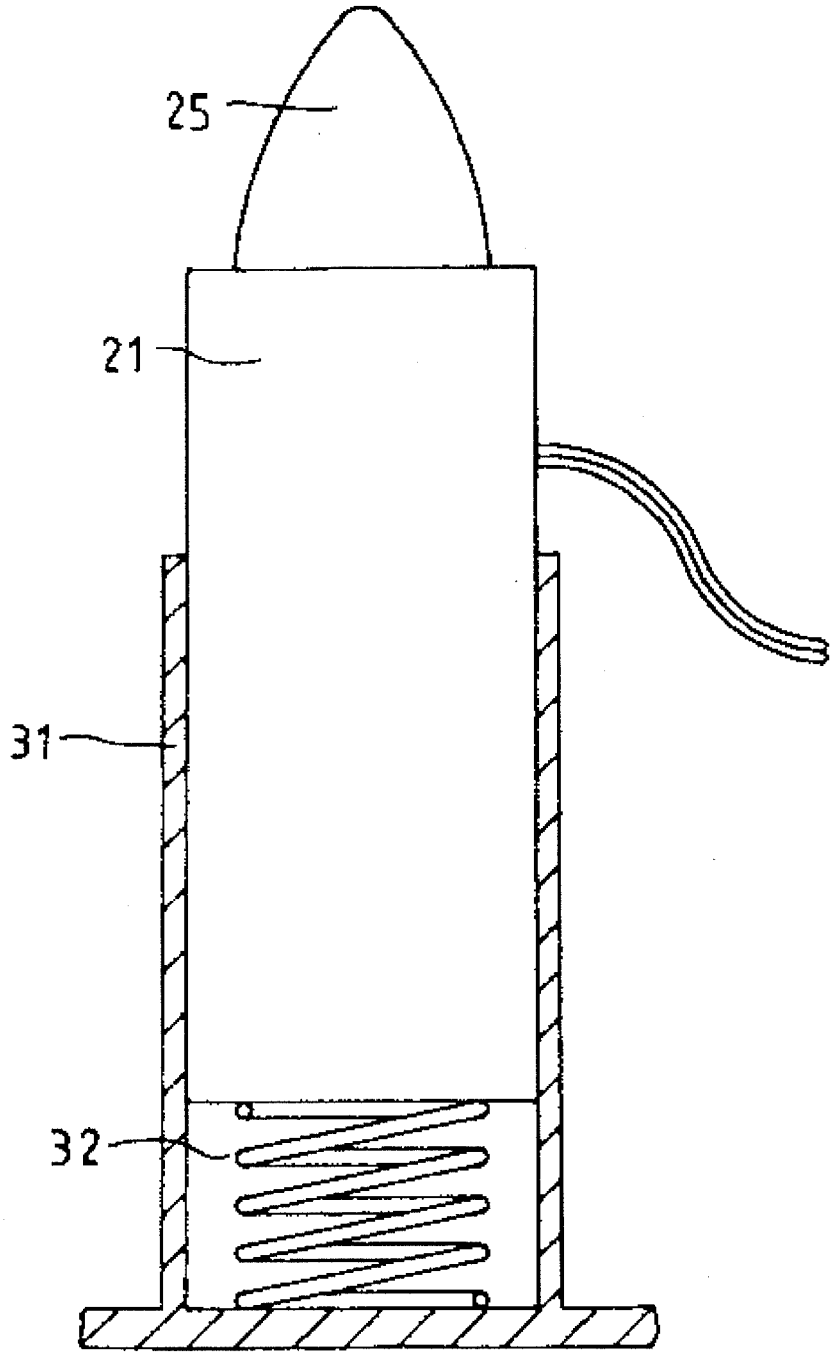
FIG. 2 is a partial cross-sectional view showing a vibrator unit in FIG. 1 received in a base.

By reference to FIG. 1, the massage apparatus is composed of a converter and power supplier 10, a plurality of vibrator units 20 (one unit is shown in the Figure only) and a base 30 of hive type. The converter and power supplier 10 is provided to convert the domestic alternating current of 120 V into a direct current of 5 V. A control panel 11 which is located at the front face on the converter 10 is provided with a power switch 12, a plurality of vibrator switches 13 and a plurality of output ports 14. Each output port 14 is electrically connected to each vibrator unit respectively. A timer 15 is located at the upper surface on the converter 10 for presetting a required massage time. An outer sleeve 21 on each vibrator unit 20 is made of formed rubber and a massage head 25 of bullet shape is located at the upper end of the sleeve 21. Each vibrator unit 20 can be held independently by hand to massage a vital point. A plurality of vertical cylinders 31 are integrated with a base plate to form the base 30 of hive type. Each vertical cylinder 31 has an inner diameter almost same as the outer diameter of the sleeve 21 so that a certain number of vibrator units 20 can be received with stability in the base 30 as required at a time to massage a specific greater area such as the waist, the arm, etc. Referring to FIG. 2 it can be clearly seen that a vibrator unit 21 is fitted in a cylinder 31 against a spring 32 at the lower part and the massage head 25 which extends out of the cylinder 31. The spring 32 acts as a shock absorber so that an uncomfortable feeling can be avoided during performing an area massage especially while a patient is lying down.

Figure 3:
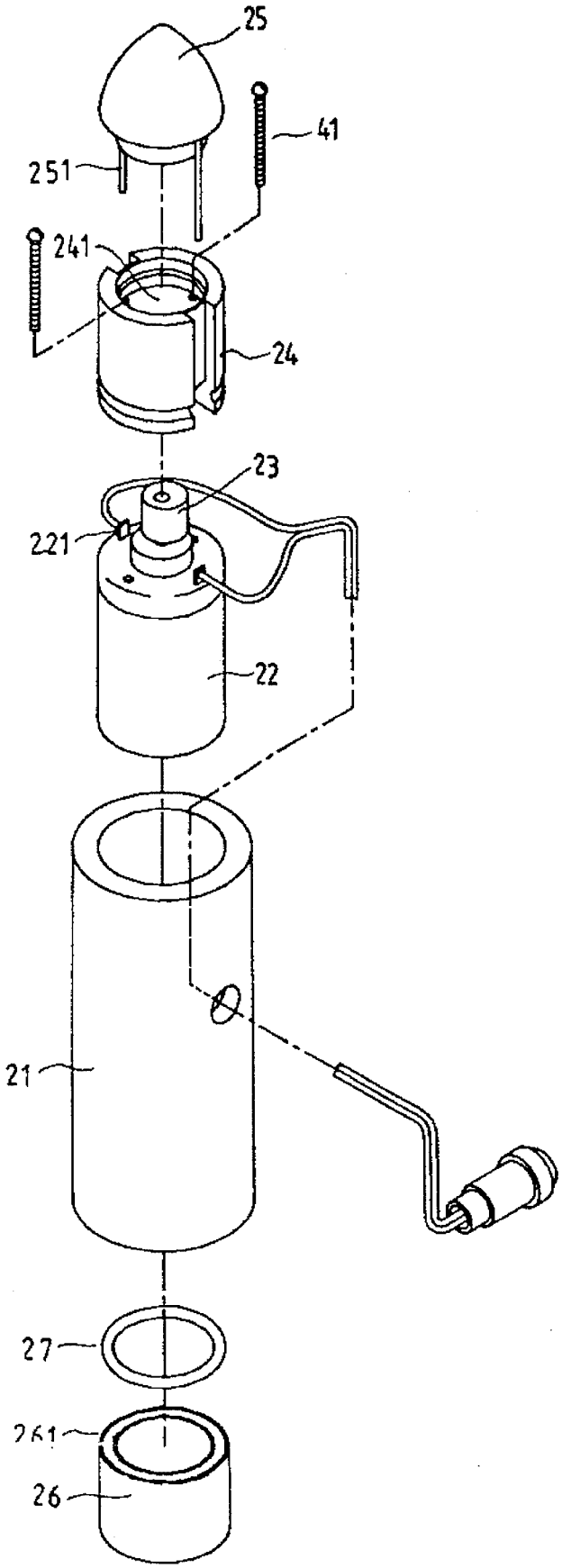
FIG. 3 is an exploded perspective view for the vibrator unit.
Figure 4:
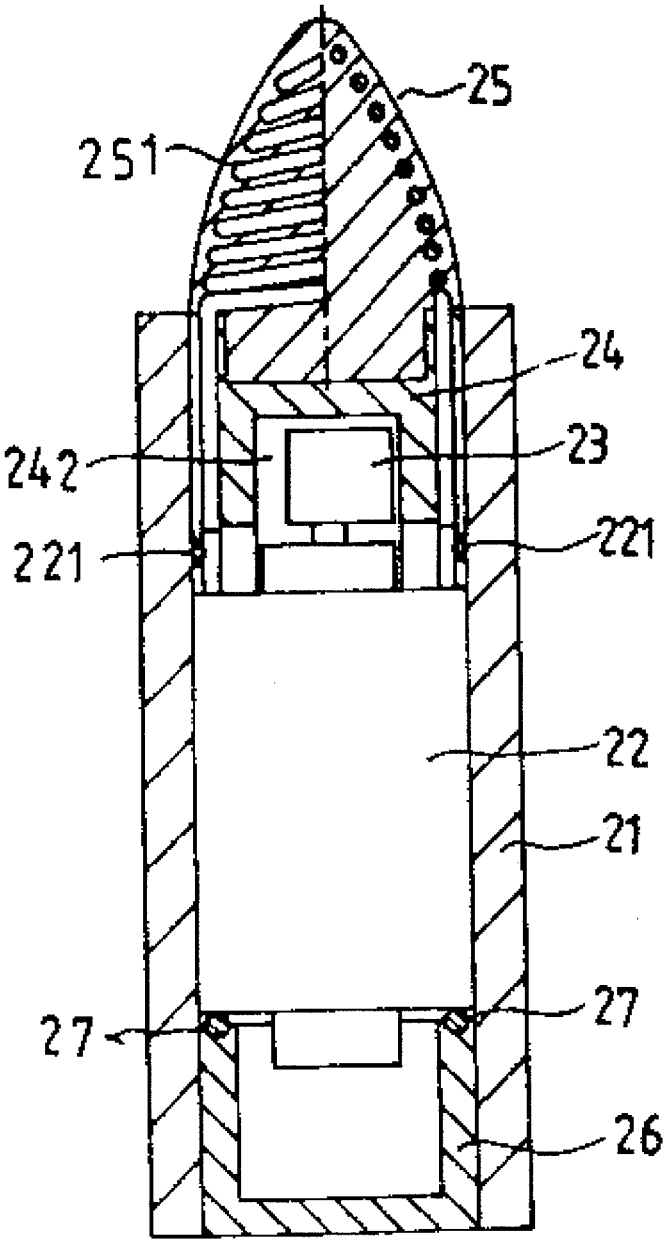
FIG. 4 is a cross-sectional view of an assembled vibrator unit.

FIG. 3 and FIG. 4 illustrate a vibrator unit 20 in detail respectively. Beside the sleeve 21, a motor 22 is provided in the vibrator unit 20 to couple with an eccentric wheel 23 at the motor shaft so as to generate a high frequency oscillation as the eccentric wheel 23 is gravitationally rotated with a centrifugal force. A cover 24 for the motor 22 is cylindrical and provided with an upper recess 241 within which fits the massage head 25. A lower recess 242 is further provided to offer a turning space for the eccentric wheel 23. The cover 24 is fastened to the motor 22 by means of two screws extending through a partition between both recesses 241 and 242. The massage head 25 is made of flexible plastics and has a bullet head shape with an embedded coil 251. Both ends of the coil 251 extend downward along two opposite vertical grooves cut into the surface of the cover 24 respectively so that an electromagnetic wave may be generated to perform an assistant treatment besides a vibrating massage while the direct current is flowing over the coil 251. A cylindrical seat 26 for the sleeve 21 is provided with an annular recess 261 at the upper end to locate a shock absorbing ring 27 to reduce the vibration transmitted via the lower casing of the motor 22.

Through the preceding description with regard to the embodiment, it is apparent that the massage apparatus with multiple vibrator units offers a better massage function for patients, that is, the Massage head 25 with an embedded coil 251 electrically connects with a same power source as the motor 22 so that each vibrator unit 20 effectively carries out a massage in association with an electromagnetic wave treatment. In addition to a point massage by means of a single vibrator unit, a group of vibrator units 20 joining with the base 30 of hive type can perform an area massage as required.

Figure 5:
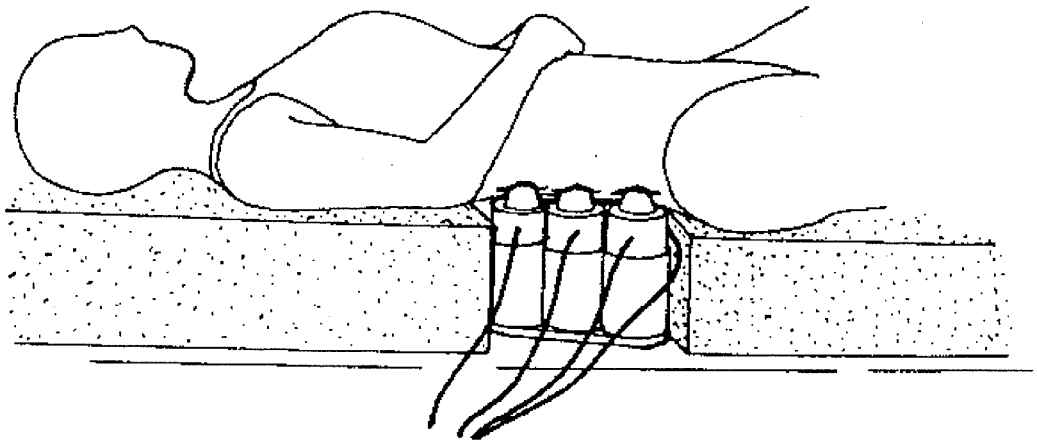
FIG. 5 and FIG. 6 are perspective views illustrating a respective application for massaging a specific greater area by means of a massage apparatus according to the present invention.
Figure 6:
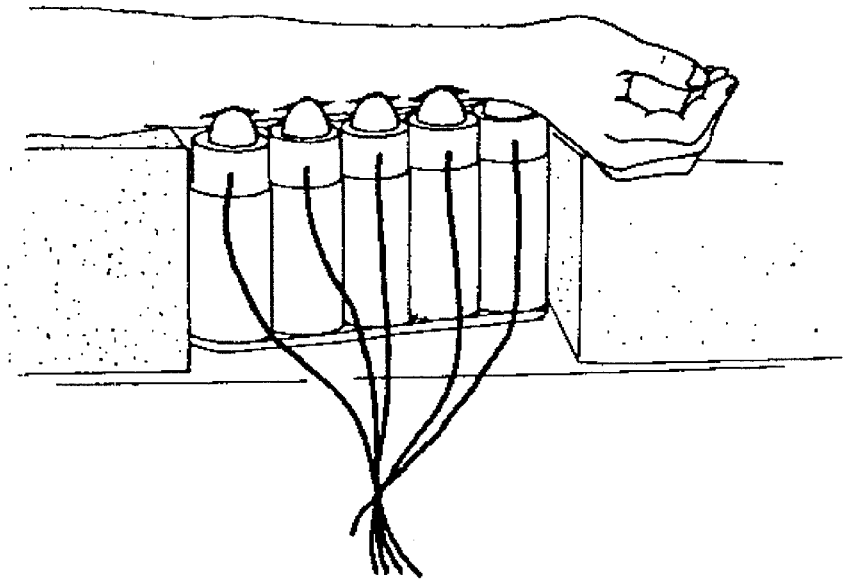

FIG. 5 and FIG. 6 show a specific number of vibrator units arranged to massage the waist and the arm of a patient respectively. Furthermore, the treatment time of the massage apparatus is capable of being preset to enhance the effect thereof. It can be appreciated that usually a local muscle hardening softens and then gradually disappears after treatment with the massage apparatus. Furthermore, circulation in capillaries of the tissues becomes normal automatically.

I claim:

1. Massage apparatus with multiple vibrator units, comprising:

a converter and power supplier wherein a plurality of connectors are arranged adjacent each other to correspond with a plurality of nearby switches;

a plurality of vibrator units wherein each unit further comprises an outer sleeve, a massage head of bullet head type with an embedded coil, an inner motor coupled to an eccentric wheel, a cylindrical cover and a lower cylindrical seat;

a base of hive type wherein a base plate is integrated with a plurality of adjacent upright cylinders each having a respective spring seating in the lower part thereof;

connecting means electrically connecting said plurality of vibrator units to the plurality of connectors of said converter; and means in said converter and power supplier for supplying direct current to said plurality of vibrators through said plurality of respective switches wherein said plurality of vibrator units can be either detachably received in said base by resting on said plurality of springs respectively in said plurality of cylinders with the respective massage heads extending outwardly for massaging a specific area or held independently by hand for massaging a single point.

2. Massage apparatus with multiple vibrator units according to claim 1, wherein said massage head is located at the upper end of said outer sleeve and is fitted to said cylindrical cover which is joined to said motor so that said eccentric wheel can be rotated in the lower part of said cover.

3. Massage apparatus with multiple vibrator units according to claim 1, wherein said motor rests on said cylindrical seat arranged at the lower end of said outer sleeve and connecting means electrically connects said motor with said coil.

* * * * *